US005471229A

United States Patent [19]

Okada et al.

[11] Patent Number: 5,471,229

[45] Date of Patent: Nov. 28, 1995

[54] DRIVING METHOD FOR LIQUID CRYSTAL DEVICE

[75] Inventors: Shinjiro Okada, Isehara; Yutaka Inaba, Kawaguchi; Kazunori Katakura, Atsugi, all of Japan

[73] Assignee: Canon Kabushiki Kaisha, Tokyo, Japan

[21] Appl. No.: 193,740

[22] Filed: Feb. 9, 1994

[30] Foreign Application Priority Data

Feb. 10, 1993 [JP] Japan ..... 5-044364

[51] Int. Cl.[6] ..... G09G 3/36

[52] U.S. Cl. ..... 345/89; 345/101

[58] Field of Search ..... 345/12, 63, 77, 345/89, 94, 95, 97, 101, 208, 210

[56] References Cited

U.S. PATENT DOCUMENTS

| | | |
|---|---|---|
| 4,367,924 | 1/1983 | Clark et al. . |
| 4,563,059 | 1/1986 | Clark et al. . |
| 4,639,089 | 1/1987 | Okada et al. . |
| 4,655,561 | 4/1987 | Kanbe et al. . |
| 4,681,404 | 7/1987 | Okada et al. . |
| 4,738,515 | 4/1988 | Okada et al. . |
| 4,778,260 | 10/1988 | Okada et al. . |
| 4,800,382 | 1/1989 | Okada et al. . |
| 4,830,467 | 5/1989 | Inoue et al. . |
| 4,836,656 | 6/1989 | Mouri et al. . |
| 4,844,590 | 7/1989 | Okada et al. . |
| 4,902,107 | 2/1990 | Tsuboyama et al. . |
| 4,917,470 | 4/1990 | Okada et al. . |
| 4,923,285 | 5/1990 | Ogino et al. . |
| 4,925,277 | 5/1990 | Inaba . |
| 4,930,875 | 6/1990 | Inoue et al. . |
| 4,932,759 | 6/1990 | Toyono et al. . |
| 4,958,912 | 9/1990 | Inaba et al. . |
| 4,958,915 | 9/1990 | Okada et al. . |
| 4,973,135 | 11/1990 | Okada et al. . |
| 5,026,144 | 6/1991 | Taniguchi et al. . |
| 5,034,735 | 7/1991 | Inoue et al. . |
| 5,132,818 | 7/1992 | Mouri et al. . |
| 5,136,282 | 8/1992 | Inaba et al. . |
| 5,250,937 | 10/1993 | Kikuo et al. ..... 345/89 |
| 5,267,065 | 11/1993 | Taniguchi et al. . |

FOREIGN PATENT DOCUMENTS 56-107216 8/1981 Japan .

OTHER PUBLICATIONS

Molecular Crystals and Liquid Crystals, M. Takeda et al., vol. 94, pp. 213–233, 1983, "Ferroelectric Liquid Crystal Electro–Optics Using the Surface Stabilized Structure."

Applied Physics Letters, Noel A. Clark et al., vol. 36, pp. 899–901, Jun. 1, 1980, "Submicrosecond Bistable Electro–optic Switching in Liquid Crystals."

*Primary Examiner*—Jeffery Brier

*Attorney, Agent, or Firm*—Fitzpatrick, Cella, Harper & Scinto

[57] ABSTRACT

A driving method is used for a liquid crystal device of the type comprising a pair of oppositely disposed electrode plates having thereon a group of scanning lines and a group of data lines, respectively, and a liquid crystal disposed between the pair of electrode plates so as to form a pixel at each intersection of the scanning lines and data lines. In the driving method, for displaying a halftone, a data line is supplied with a halftone signal selected from plural halftone signals determined according to a first relationship between applied voltage and transmittance of a pixel. On the other hand, for displaying a minimum or a maximum transmittance, a data line is supplied with an extreme signal determined according to a second relationship, different from the first one, between applied voltage and transmittance of a pixel. The extreme signal is applied for displaying a minimum or maximum transmittance state. As a result, a gradational display is performed at a high contrast ratio even when a temperature change occurs.

9 Claims, 12 Drawing Sheets

V = 0

V < Vth

Vth < V < Vsat

Vsat < V

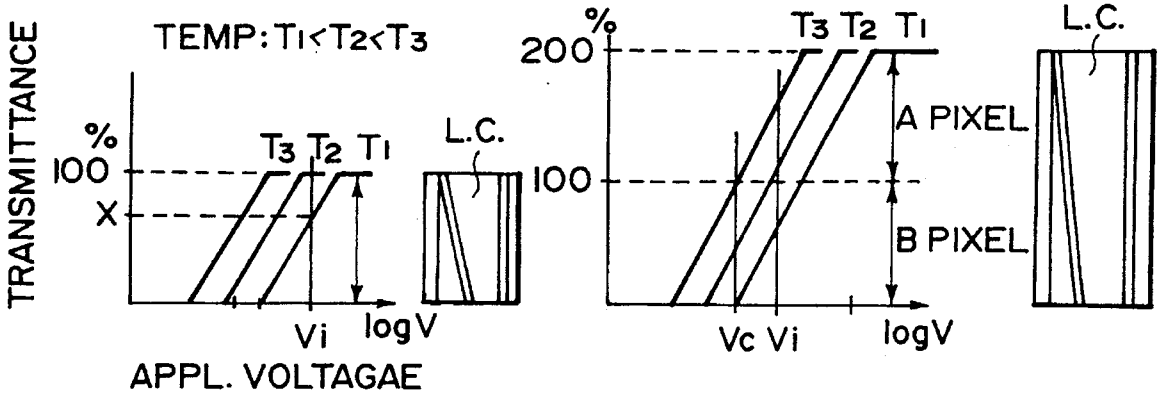
FIG. 7A
FIG. 7B
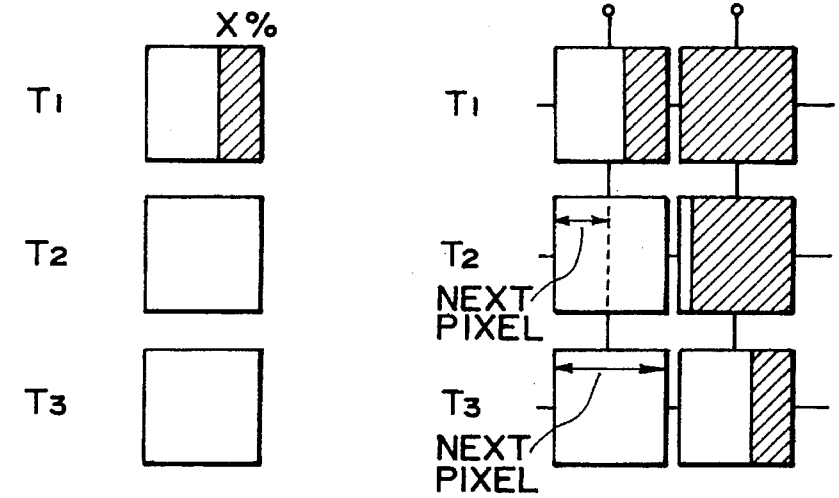
FIG. 7C
FIG. 7D

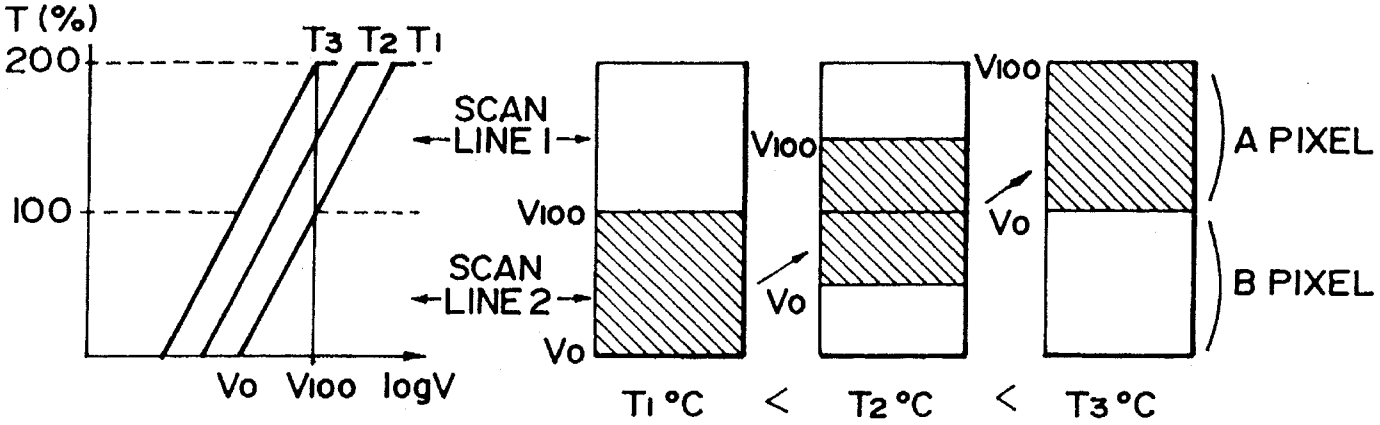
FIG. 8A
FIG. 8B
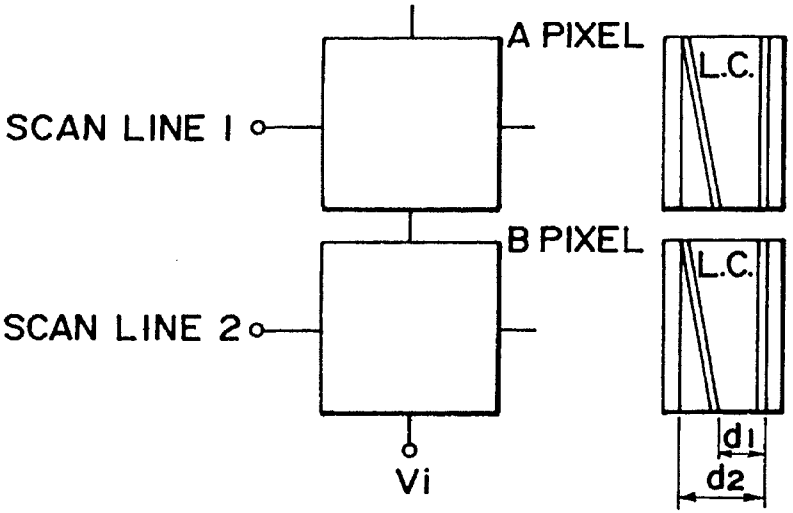
FIG. 9A
FIG. 9B

IH = 3ΔT
Ve: CLEAR VOLTAGE Vs: SCAN SIGNAL VOLTAGE
Vi: DATA SIGNAL VOLTAGE
ΔT: 1ST. WRITING PERIOD
δ: 2ND. WRITING PERIOD
t1, t2: INITIAL PERIOD DETERMINED IN RELATION TO DATA SIGNAL

DRIVING METHOD FOR LIQUID CRYSTAL DEVICE

FIELD OF THE INVENTION AND RELATED ART

The present invention relates to a method for driving a liquid crystal device usable as a display device included in television receivers, view finders for video cameras, terminal monitors for computers, etc.

A liquid crystal display device of a passive matrix drive scheme using a TN-liquid crystal has been known as one which can be produced at a relatively low cost. However, this type of liquid crystal display device has a limitation in respect of crosstalk or contrast and cannot be considered as being suitable for a display device having high-density display lines, e.g., a liquid crystal television panel.

Clark and Lagerwall have disclosed a bistable ferroelectric liquid crystal device using a surface-stabilized ferroelectric liquid crystal in, e.g., Applied Physics Letters, Vol. 36, No. 11 (Jun. 1, 1980), p.p. 899– 901; Japanese Laid-Open Patent Application (JP-A) 56-107216, U.S. Pat. Nos. 4,367,924 and 4,563,059. Such a bistable ferroelectric liquid crystal device has been realized by disposing a liquid crystal between a pair of substrates disposed with a spacing small enough to suppress the formation of a helical structure inherent to liquid crystal molecules in chiral smectic C phase (SmC*) or H phase (SmH*) of bulk state and align vertical (smectic) molecular layers each comprising a plurality of liquid crystal molecules in one direction.

Further, as a display device using such a ferroelectric liquid crystal (FLC), there is known one wherein a pair of transparent substrates respectively having thereon a transparent electrode and subjected to an aligning treatment are disposed to be opposite to each other with a cell gap of about 1–3 μm therebetween so that their transparent electrodes are disposed on the inner sides to form a blank cell, which is then filled with a ferroelectric liquid crystal, as disclosed in U.S. Pat. No. 4,639,089; 4,655,561; and 4,681,404.

The above-type of liquid crystal display device using a ferroelectric liquid crystal has two advantages. One is that a ferroelectric liquid crystal has a spontaneous polarization so that a coupling force between the spontaneous polarization and an external electric field can be utilized for switching. Another is that the long axis direction of a ferroelectric liquid crystal molecule corresponds to the direction of the spontaneous polarization in a one-to-one relationship so that the switching is effected by the polarity of the external electric field. More specifically, the ferroelectric liquid crystal in its chiral smectic phase show bistability, i.e., a property of assuming either one of a first and a second optically stable state depending on the polarity of an applied voltage and maintaining the resultant state in the absence of an electric field. Further, the ferroelectric liquid crystal shows a quick response to a change in applied electric field. Accordingly, the device is expected to be widely used in the field of, e.g., high-speed and memory-type display apparatuses.

A ferroelectric liquid crystal generally comprises a chiral smectic liquid crystal (SmC* or SmH*), of which molecular long axes form helixes in the bulk state of the liquid crystal. If the chiral smectic liquid crystal is disposed within a cell having a small gap of about 1–3 μm as described above, the helixes of liquid crystal molecular long axes are unwound (N.A. Clark, et al., MCLC (1983), Vol. 94, p.p. 213–234).

A liquid crystal display apparatus having a display panel constituted by such a ferroelectric liquid crystal device may be driven by a multiplexing drive scheme as described in U.S. Pat. No. 4,655,561, issued to Kanbe et al to form a picture with a large capacity of pixels. The liquid crystal display apparatus may be utilized for constituting a display panel suitable for, e.g., a word processor, a personal computer, a micro-printer, and a television set.

A ferroelectric liquid crystal has been principally used in a binary (bright-dark) display device in which two stable states of the liquid crystal are used as a light-transmitting state and a light-interrupting state but can be used to effect a multi-value display, i.e., a halftone display. In a halftone display method, the areal ratio between bistable states (light transmitting state and light-interrupting state) within a pixel is controlled to realize an intermediate light-transmitting state. The gradational display method of this type (hereinafter referred to as an "areal modulation" method) will now be described in detail.

FIGS. 1A and 1B are graphs schematically representing a relationship between a transmitted light quantity I through a ferroelectric liquid crystal cell and a switching pulse voltage V. More specifically, FIG. 1A shows plots of transmitted light quantities I given by a pixel versus voltages V when the pixel initially placed in a complete light-interrupting (dark) state is supplied with single pulses of various voltages V and one polarity as shown in FIG. 1B. When a pulse voltage V is below threshold Vth (V< Vth), the transmitted light quantity does not change and the pixel state is as shown in FIG. 2B which is not different from the state shown in FIG. 2A before the application of the pulse voltage. If the pulse voltage V exceeds the threshold Vth (Vth< V< Vsat), a portion of the pixel is switched to the other stable state, thus being transitioned to a pixel state as shown in FIG. 2C showing an intermediate transmitted light quantity as a whole. If the pulse voltage V is further increased to exceed a saturation value Vsat (Vsat< V), the entire pixel is switched to a light-transmitting state as shown in FIG. 2D so that the transmitted light quantity reaches a constant value (i.e., is saturated). That is, according to the areal modulation method, the pulse voltage V applied to a pixel is controlled within a range of Vth< V< Vsat to display a halftone corresponding to the pulse voltage.

However, actuality, the voltage (V)—transmitted light quantity (I) relationship shown in FIGS. 1A ad 1B depend on the cell thickness and temperature. Accordingly, if a display panel has an unintended cell thickness distribution or undergoes a temperature distribution, the display panel can display different gradation levels in response to a pulse voltage having a constant voltage.

FIG. 3 is a graph for illustrating the above phenomenon which is a graph showing a relationship between pulse voltage (V) and transmitted light quantity (I) similar to that shown in FIG. 1 but showing two curves including a curve H representing a relationship at a high temperature and a curve L at a low temperature. In a display panel having a large display size, it is rather common that the panel undergoes a temperature distribution. In such a case, however, even if a certain halftone level is intended to be displayed by application of a certain drive voltage Vap, the resultant halftone levels can be fluctuated within the range of $I_1$ to $I_2$ as shown in FIG. 3 within the same panel, thus failing to provide a uniform gradational display state.

In order to solve the above-mentioned problem, our research and development group has already proposed a drive method (hereinafter referred to as the "four pulse method") in U.S. patent application Ser. No. 681,933, filed Apr. 8, 1991. In the four pulse method, as illustrated in FIGS. 4 and 5, all pixels having mutually different thresholds on a common scanning line in a panel are supplied with plural pulses (corresponding to pulses (A)–(D) in FIG. 4) to show consequently identical transmitted quantities as shown at FIG. 4(D). In FIG. 5, $T_1$, $T_2$ and $T_3$ denote selection periods set in synchronism with the pulses (B), (C) and (D), respectively. Further, $Q_0$, $Q_0'$, $Q_1$, $Q_2$ and $Q_3$ in FIG. 4 represent gradation levels of a pixel, inclusive of $Q_0$ representing black (0 %) and $Q_0'$ representing white (100%). Each pixel in FIG. 4 is provided with a threshold distribution within the pixel increasing from the leftside toward the right side as represented by a cell thickness increase.

Our research and development group has also proposed a drive method (a so-called "pixel shift method", as disclosed in U.S. patent application Ser. No. 984,694, filed Dec. 2, 1992 and entitled "LIQUID CRYSTAL DISPLAY APPARATUS"), requiring a shorter writing time than in the four pulse method. In the pixel shift method, plural scanning lines are simultaneously supplied with different scanning signals for selection to provide an electric field intensity distribution spanning the plural scanning lines, thereby effecting a gradational display. According to this method, a variation in threshold due to a temperature variation can be absorbed by shifting a writing region over plural scanning lines.

An outline of the pixel shift method will now be described below.

A liquid crystal cell (panel) suitably used may be one having a threshold distribution within one pixel. Such a liquid crystal cell may for example have a sectional structure as shown in FIG. 6. The cell shown in FIG. 6 has an FLC layer 55 disposed between a pair of glass substrates 53 including one having thereon transparent stripe electrodes 53 constituting data lines and an alignment film 54 and the other having thereon a ripple-shaped film 52 of, e.g., an insulating resin, providing a saw-tooth shape cross section transparent stripe electrodes 52 constituting scanning lines and an alignment film 54. In the liquid crystal cell, the FLC layer 55 between the electrodes has a gradient in thickness within one pixel so that the switching threshold of FLC is also caused to have a distribution. When such a pixel is supplied with an increasing voltage, the pixel is gradually switched from a smaller thickness portion to a larger thickness portion.

The switching behavior is illustrated with reference to FIG. 7A. Referring to FIG. 7A, a panel in consideration is assumed to have portions having temperatures $T_1$, $T_2$ and $T_3$. The switching threshold voltage of FLC is lowered at a higher temperature. FIG. 7A shows three curves each representing a relationship between applied voltage and resultant transmittance at temperature $T_1$, $T_2$ or $T_3$.

Incidentally, the threshold change can be caused by a factor other than a temperature change, such as a layer thickness fluctuation, but an embodiment of the present invention will be described while referring to a threshold change caused by a temperature change, for convenience of explanation.

As is understood from FIG. 7A, when a pixel at a temperature $T_1$ is supplied with a voltage Vi, a transmittance of X % results at the pixel. If, however, the temperature of the pixel is increased to $T_2$ or $T_3$, a pixel supplied with the same voltage Vi is caused to show a transmittance of 100%, thus failing to perform a normal gradational display. FIG. 7C shows inversion states of pixels after writing. Under such conditions, written gradation data is lost due to a temperature change, so that the panel is applicable to only a limited use of display device.

In contrast thereto, it becomes possible to effect a gradational display stable against a temperature change by display data for one pixel on two scanning lines S1 and S2 as shown in FIG. 7D.

The drive scheme will be described in further detail hereinbelow.

(1) A ferroelectric liquid crystal cell as shown in FIG. 12 having a continuous threshold distribution within each pixel is provided. It is also possible to use a cell structure providing a potential gradient within each pixel as proposed by our research and development group in U.S. Pat. No. 4,815,823 or a cell structure having a capacitance gradient. In any way, by providing a continuous threshold distribution within each cell, it is possible to form a domain corresponding to a bright state and a domain corresponding to a dark state in mixture within one pixel, so that a gradational display becomes possible by controlling the areal ratio between the domains.

The method is applicable to a stepwise transmittance modulation (e.g., at 16 levels) but a continuous transmittance modulation is required for an analog gradational display.

(2) Two scanning lines are selected simultaneously. The operation is described with reference to FIGS 8A and 8B shows an overall transmittance—applied voltage characteristic for combined pixels on two scanning lines. In FIG. 8A, a transmittance of 0–100% is allotted to be displayed by a pixel B on a scanning line 2 and a transmittance of 100–200% is allotted to be displayed by a pixel A on a scanning line 1. More specifically, as one pixel is constituted by one scanning line, a transmittance of 200% is displayed when both the pixels A and B are wholly in a transparent state by scanning two scanning lines simultaneously. Herein, two scanning lines are selected for displaying one gradation data but a region having an area of one pixel is allotted to displaying one gradation data. This is explained with reference to FIG. 8B.

At temperature $T_1$, inputted gradation data is written in a region corresponding to 0 % at an applied voltage $V_0$ and in a region corresponding to 100% at $V_{100}$. As shown in FIG. 8B, at temperature $T_1$, the range (pixel region) is wholly on the scanning line 2 (as denoted by a hatched region in FIG. 8B). When the temperature is raised from $T_1$ to $T_2$, however, the threshold voltage of the liquid crystal is lowered correspondingly, the same amplitude of voltage causes an inversion in a larger region in the pixel than at temperature $T_1$.

For correcting the deviation, a pixel region at temperature $T_2$ is set to span on scanning lines 1 and 2 (a hatched portion at $T_2$ in FIG. 8B).

Then, when the temperature is further raised to temperature $T_3$, a pixel region corresponding to an applied voltage in the range of $V_0$–$V_{100}$ is set to be on only the scanning line 1 (a hatched portion at $T_3$ in FIG. 8B).

By shifting the pixel region for a gradational display on two scanning lines depending on the temperature, it becomes possible to retain a normal gradation display in the temperature region of $T_1$–$T_3$.

(3) Different scanning signals are applied to the two scanning lines selected simultaneously. As described at (2) above, in order to compensate for the change in threshold of liquid crystal inversion due to a temperature range by selecting two scanning lines simultaneously, it is necessary to apply different scanning signals to the two selected scanning lines. This point is explained with reference to FIGS. 7A and 7B.

Scanning signals applied to scanning lines 1 and 2 are set so that the threshold of a pixel B on the scanning line 2 and the threshold of a pixel A on the scanning line 1 varies continuously. Referring to FIG. 7B, a transmittance-voltage curve at temperature 1 indicates that a transmittance up to 100% is displayed in a region on the scanning line 2 and a transmittance thereabove and up to 200% is displayed in a region on the scanning line 1. It is necessary to set the transmittance curve so that it is continuous and has an equal slope spanning from the pixel B to the pixel A.

As a result, even if the pixel A on the scanning line 1 and the pixel B on the scanning line 2 are set to have identical cell shapes as shown in FIG. 9B, it becomes possible to effect a display substantially similar to that in the case where the pixel A and the pixel B are provided with a continuous threshold characteristic (cell at the right side of FIG. 7B).

In case of effecting a gradational display according to the above-mentioned pixel shift method, it is desirable to effect a white reset (resetting for providing a maximum transmittance state) and a black reset (resetting for providing a minimum transmittance state) alternately line by line so as to shorten a one-line selection period. Accordingly, a black display state may be formed in two ways, i.e., 1) by resetting into a white state and then writing a black state and 2) by resetting into a black state and then not effecting a white writing.

However, as the response of FLC to an input pulse is very high, a non-negligible light leakage is caused in the case where a black state is written after once resetting into a white state compared with the case where a black state is retained without writing into a white state after resetting into the black state, while the black state is finally displayed in either case.

Now, a change in contrast or gradation level due to a white resetting operation is considered. The contrast ratio obtained by effecting only the black reset is represented by $R_B = I_W/I_B$ where $I_W$ denotes a transmittance in the white state and $I_B$ denotes a transmittance in the black state.

In case where scanning lines are subjected to a white reset and a black reset alternately line by line, a white reset (erasure) time $T_W$ for a white reset line may be represented by: $T_W = H \times f$, wherein H denotes a one scanning period and f denotes a frame frequency. Accordingly, a contrast ratio $R_W$ in case of the alternate resetting is given as follows:

$$R_W = I_W/(I_B + H.f.I_W) = R_B/(1 + H.f.R_B).$$

In case of H=100 μs and f=15 Hz, the results show in the following Table 1 are attained.

TABLE 1

| $R_W$ | $R_B$ |
|---|---|
| 46.5 | 50 |
| 87.0 | 100 |
| 122.4 | 150 |

Table 1 shows that the decrease in contrast ratio due to the white reset is about 10% compared with the case of only the black reset is effected.

The change in gradation level is caused by white leakage for 1.5 msec per 1 sec and may correspond to 0.15% if the white state level is assumed to be 1. This is not so large if a transmittance change for 1 gradation level within a total of 256 gradation levels corresponding to 0.39% is considered. However, if the frame frequency f is increased or the one-line scanning period H is increased, the gradation level can be affected.

In a scanning scheme wherein the reset direction is changed alternately line by line and also changed for each frame, the change in contrast ratio $R_{WB}$ may be summarized in the following Table 2.

TABLE 2

| $R_{WB}$ | $R_B$ |
|---|---|
| 48.2 | 50 |
| 93.0 | 100 |
| 134.8 | 150 |

The contrast change is reduced to within 10%.

However, in case where a temperature change occurs at the timing of writing (or a temperature deviation occurs along one panel) in the pixel shift method, the contrast change due to a white reset cannot be ignored. More specifically, as the temperature increases from $T_1$ to $T_3$ in FIG. 7D, a pixel not expected to be written in "white" after a black reset can be written in white at a high temperature part. FIG. 10 is a schematic view for illustrating how different display states can occur at pixels having different threshold values.

Now, referring to FIG. 10, it is assumed that there are two pixels both showing a half of the maximum transmittance level as shown at R but having different threshold levels. Then, all the pixels including the above-mentioned two pixels on a selected scanning line are supplied with a line-clear signal to be wholly reset into "black" as shown at $a_1$ and $a_2$, by application of a scanning signal regardless of what voltages are applied to respective data lines.

Now, it is assumed that the applied signal is set based on a high threshold pixel. Before writing "black", a voltage signal $V_{il}$ not causing an inversion of the previously reset black state for a high threshold pixel H is applied as shown in FIG. 11 (showing a relationship between transmittance T—log V (applied voltage) for two types of pixels showing different threshold characteristics H and L. As a result of the application of the voltage $V_{il}$, a black state is retained as shown at $b_1$ at a high threshold pixel but a transmittance of 70% results as shown at $b_1$ at a low threshold pixel. This has an effect of causing a lowering in contrast ratio similar to the one due to the above-mentioned "white" reset. As the method is designed to compensate for such a change, in a subsequent step, the low threshold pixel is also written into "black" as shown at $c_2$ similarly as at $c_1$ at the high-threshold pixel by application of a compensation pulse.

If the low-threshold pixel is caused to have a further low threshold characteristic due to a further temperature increase, etc., the state $b_2$ become a completely "white" state (maximum transmittance). In such a case, the $b_2$ "white" state display can also be regarded as a "white" reset for subsequently displaying a $c_2$ state. In the method, a prescribed time interval (standing period) has to be placed between the step $b_1$ ($b_2$) and the step $c_1$ ($c_2$). For example, the standing period amounts to 500 μsec.

If the standing period is denoted by u and the frame frequency is denoted by f, a contrast ratio Ru at a high temperature obtained in a case where the resetting direction is changed for each line and for each frame may be expressed by the following equation in comparison with the case in which only a black reset is effected in the absence of a temperature change:

$$Ru = I_W/(I_B + u.f.I_W) = R_{BW}/(1 + u.f.R_{BW})$$

Now, with the values of f= 15 Hz and u= 500 μsec, the contrast ratio Ru may be calculated to have results shown in the following Table 3.

TABLE 3

| Ru | $R_{BW}$ | $R_B$ |
|---|---|---|
| 35.4 | 48.2 | 50 |
| 54.8 | 93.0 | 100 |
| 67.0 | 134.8 | 150 |

Thus, a remarkably low contrast ratio results.

The transmittance level change amounts to 0.0075 (when "white" is regarded as 1). This roughly corresponds to a change for two levels (one level= 1/256= 0.0039) in a 256-level gradation display.

SUMMARY OF THE INVENTION

An object of the present invention is to provide a driving method for a liquid crystal device having solved the above-mentioned problems.

A more specific object of the present invention is to provide a driving method for a liquid crystal device capable of suppressing a contrast change due to a local change or a temperature change in threshold characteristic.

According to the present invention, there is provided a driving method for a liquid crystal device of the type comprising a pair of oppositely disposed electrode plates having thereon a group of scanning lines and a group of data lines, respectively, and a liquid crystal disposed between the pair of electrode plates so as to form a pixel at each intersection of the scanning lines and data lines; said driving method comprising:

for displaying a halftone, applying to a data line a halftone signal selected from plural halftone signals determined according to a first relationship between applied voltage and transmittance of a pixel, and for displaying a minimum or a maximum transmittance, applying to a data line an extreme signal determined according to a second relationship between applied voltage and transmittance of a pixel, said second relationship being different from said first relationship.

According to another aspect of the present invention, there is provided a driving method for a liquid crystal device of the type comprising a pair of oppositely disposed electrode plates having thereon a group of scanning lines and a group of data lines, respectively, and a ferroelectric liquid crystal disposed between the pair of electrode plates so as to form a pixel at each intersection of the scanning lines and data lines; wherein:

each pixel is provided with a threshold distribution therein, and a gradational display is performed by first writing of writing an extreme state formed by application of a reset pulse, and second writing of writing a state formed by application of a signal of a polarity of a writing signal and a halftone state, said first writing and second writing being performed by application of data signals according to mutually discontinuous modulation schemes.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 7A–7D are views for illustrating a pixel shift method.

FIGS. 8A, 8B, 9A and 9B are other views for illustrating a pixel shift method.

DESCRIPTION OF THE PREFERRED EMBODIMENTS

Figure 12A:
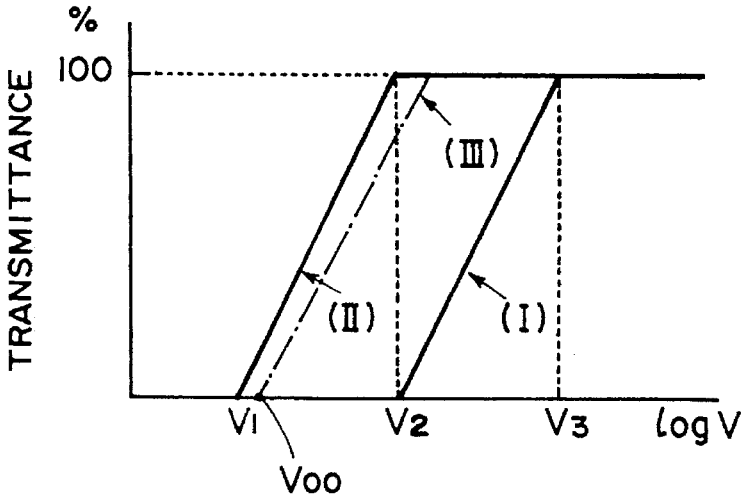
FIG. 12A is a graph showing relationships between transmittance and applied voltage of a liquid crystal device used in the present invention.

An embodiment of the present invention is described with reference to FIGS. 12A–12C regarding gradation writing according to a voltage modulation scheme. FIG. 12A is a graph showing a relationship between transmittance (on the ordinate) and applied voltage (on the abscissa in a logarithmic scale) so as to represent a temperature-dependence change of a characteristic curve by a parallel shift of the curve.

In FIG. 12A, a curve (I) represents a characteristic (first relationship) at a low temperature state (higher threshold state) and a curve (II) represents a characteristic (second relationship) at a high temperature state (lower threshold characteristic). A gradational display is performed in a voltage range of $V_2$–$V_3$ at a low temperature pixel and in a voltage range of $V_1$–$V_2$ at a high temperature pixel.

Figure 12B:
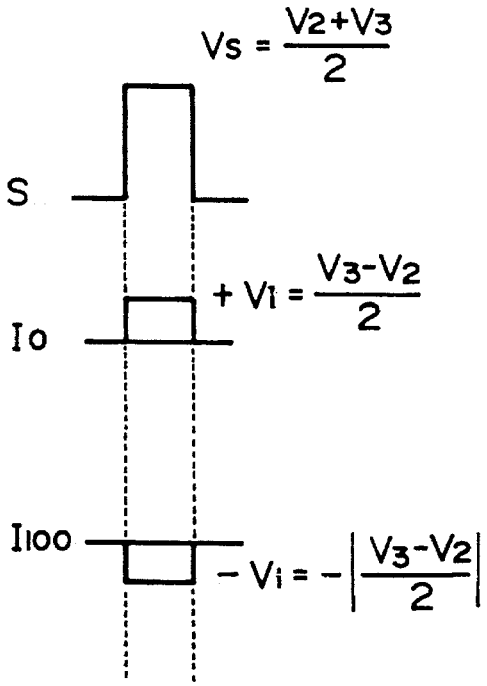
FIGS. 12B and 12C show voltage signals applied to the liquid crystal device.

According to a related modulation scheme, these pixels may be supplied with voltage signals including a scanning signal and corresponding data signals set as shown in FIG. 12B, wherein the data signals continuously change their voltages from $I_0$ to $I_{100}$.

Now, if the scanning signal S is set to have a voltage value of $(V_2+V_3)/2$ and a data signal of $V_{I0}=-(V_3-V_2)/2$ is applied in synchronism therewith, a pixel concerned is supplied with a voltage $V_2$ giving a transmittance of 0%. On the other hand, if a data signal of $V_{I100}=-(V_3-V_2)/2$ is applied, the pixel is supplied with a voltage $V_3$ giving a transmittance of 100%. Accordingly, the data signal can provide a continuous gradational display in the voltage range of $V_{I0}$ to $V_{I100}$.

In case of a drive according to the pixel shift method if accompanied with a temperature change, a high temperature pixel written toward "white" by the first writing can be left standing for 500–600 μsec until the second writing, during which light leakage can impair the contrast.

Accordingly, in order to display "black" (T (transmittance)= 0 %), a voltage of not $V_2$ but $V_1$ is applied to the pixel. In other words, a continuous signal modulation is effected in the range of $V_2$ to $V_3$ and, in addition thereto, a voltage $V_1$ not concerned with the continuous signal modulation is used.

As a result, a pixel for displaying "black" is free from a period of standing at "white" peculiar to the pixel shift method regardless of whether it is at a high-temperature part or a low-temperature part, thus providing an improved contrast.

Figure 12C:
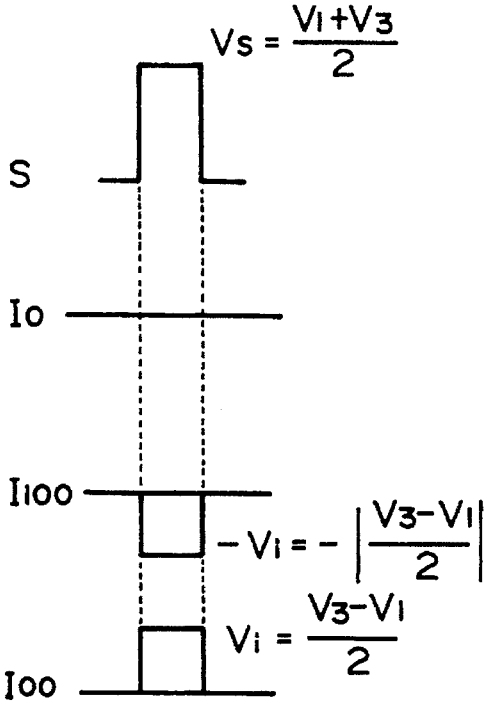

An example of the driving waveforms according to the above-mentioned drive scheme is shown in FIG. 12C.

Referring to FIG. 12C, the scanning signal is set to have a voltage $Vs=(V_1+V_3)/2$, and the data signal is subjected to a voltage modulation in a voltage range of from 0 to $-(V_3-V_1)/2$. Further, in addition thereto, a voltage of $V_{I00}=(V_3-V_1)/2$ is applied at the time of displaying "black".

Figure 10:
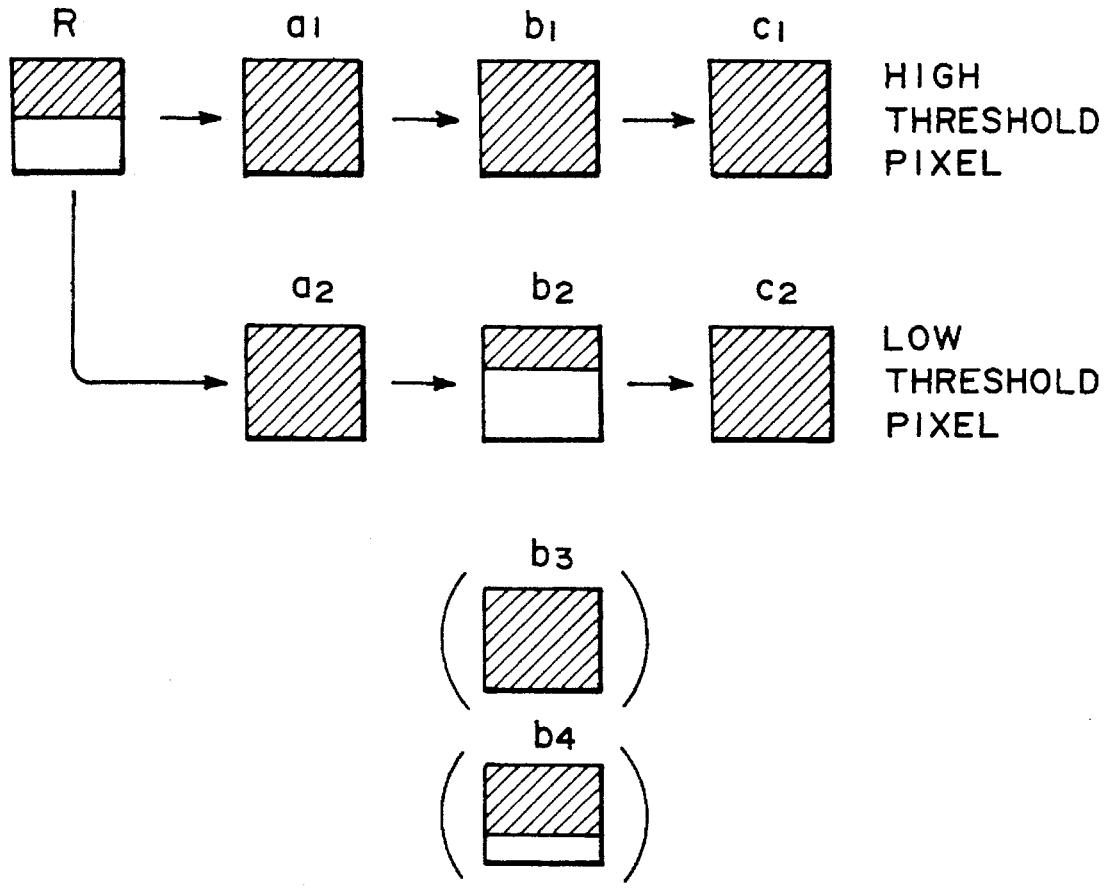
FIG. 10 is a schematic view of sequential display states at pixels for illustrating a driving method for a liquid crystal device.
Figure 11:
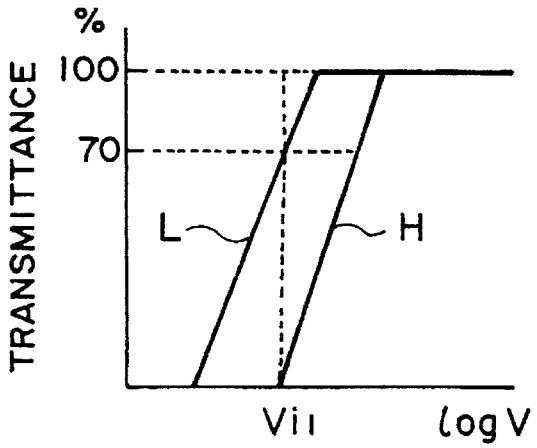
FIG. 11 is a graph showing relationships between transmittance and applied voltage.

As a result, even at a low threshold pixel which has shown a display state as shown at $b_2$ in FIG. 10 according to the related drive scheme can provide a display state $b_3$ according the preferred embodiment of the present invention.

In this way, this embodiment uses a halftone modulation signal determined according to a first relationship between applied voltage and transmittance (V-T characteristic) for a pixel placed in a certain reference state and a "black" signal determined according to a second relationship for the pixel placed in a different state.

Further, in case where a transmittance of, e.g., about 10% as shown at $b_4$ in FIG. 10 is acceptable instead of a minimum transmittance, it is possible to use a voltage $V_{00}$ as a "black" signal determined according to another V-T characteristic represented by a dot-and-dash line (III) in FIG. 12.

By discontinuously setting the modulation ranges of the data signal, it becomes possible to improve the display quality of a gradational display or writing in case where a temperature change is liable.

By the above-mentioned method, it is possible to reduce the transmitted light quantity through a "black"—displaying pixel to obviate the influence of a temperature change on the "black"—"white" contrast. However, a low-temperature pixel and a high-temperature pixel can also cause a difference due to light leakage during a period between the first writing and the second writing at a respective gradation level at the time of gradational display. This difference however corresponds to merely two gradation levels and do not significantly affect the display quality, if the "black" level is set to a constant transmitted light quantity level regardless of the direction of clearing or resetting. The optical contrast is generally defined by a ratio between a maximum transmitted light quantity and a minimum transmitted quantity and a fluctuation at an intermediate level is not so sensitively noticeable to human eyes if the "black" is kept at a constant level.

Further, if a drive scheme of alternating the clearing direction for each frame, the "black" and "white" display states occur alternately every other frame during the period between the first and second writing even at a high-temperature pixel. Consequently, identical light quantities are obtained at three levels of 0%, 50% and 100% regardless of the temperature, so that the display quality can be remarkably improved if the "black" level is stably displayed.

The gradation modulation signal for gradational display used in the present invention may be a pulse-width modulation signal having a constant voltage in addition to the above-mentioned voltage modulation signal. It is also possible to use a combination of the voltage modulation and the pulse modulation. Further, it is also possible to use phase modulation as a type of the pulse width modulation.

Figure 13:
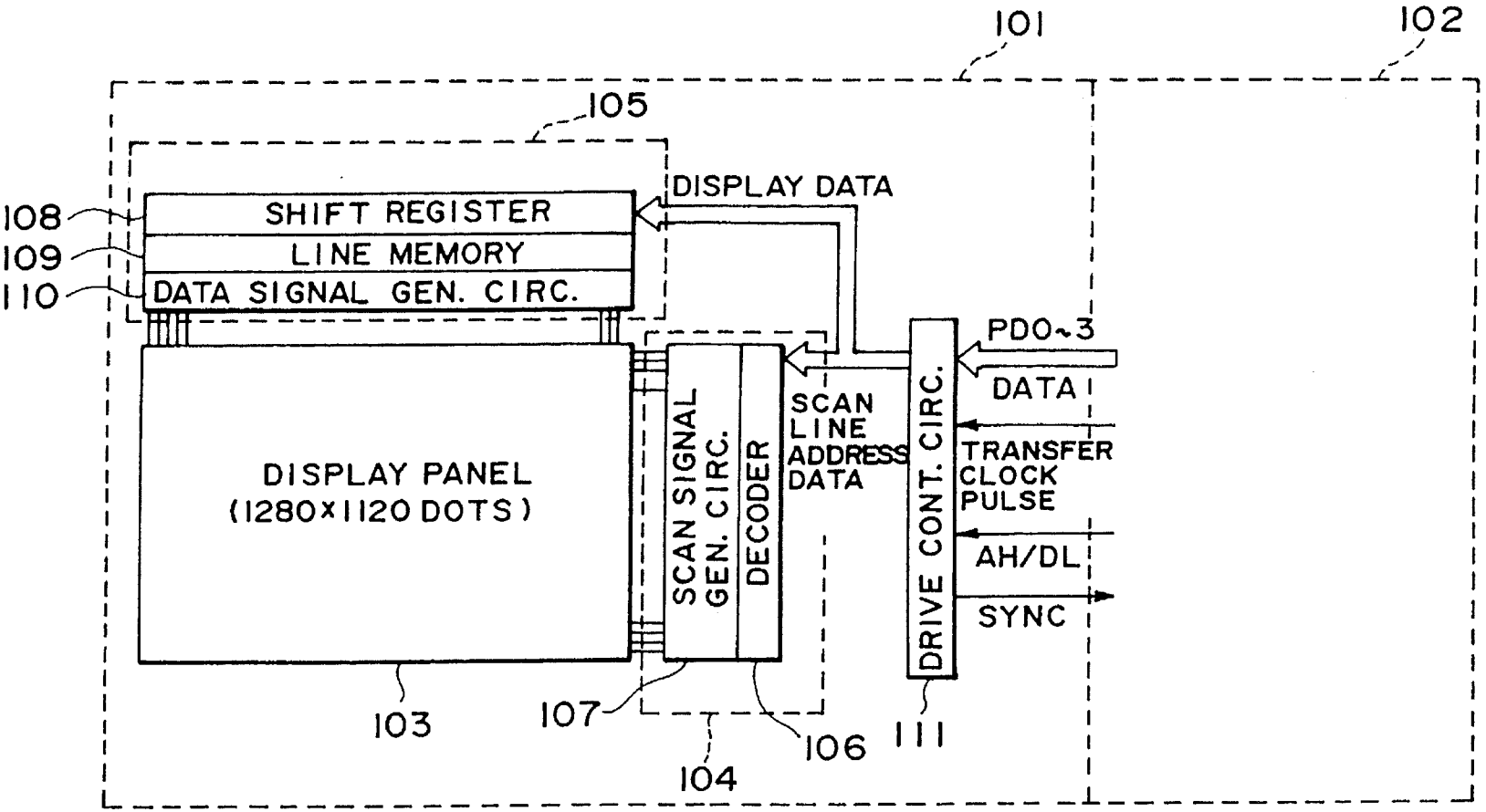
FIG. 13 is a block diagram of a drive circuit applicable to the invention.
Figure 14:
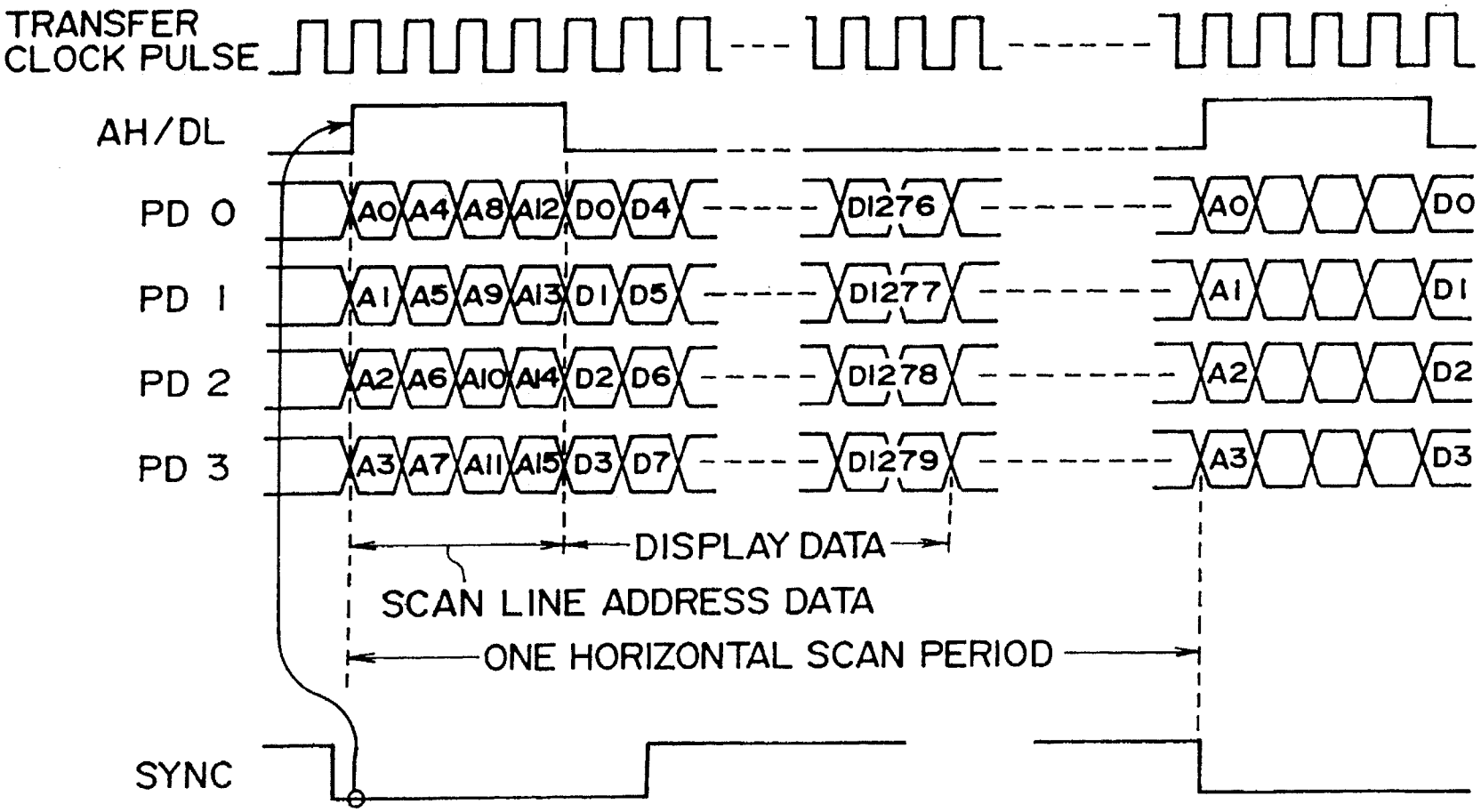
FIG. 14 is a time chart for the driving circuit shown in FIG. 13.

FIG. 13 is a block diagram of a control system for a display apparatus according to the present invention, and FIG. 14 is a time chart for communication of image data therefor. Hereinbelow, the operation of the apparatus will be described with reference to these figures.

A graphic controller 102 supplies scanning line address data for designating a scanning electrode and image data PD0–PD3 for pixels on the scanning line designated by the address data to a display drive circuit constituted by a scanning line drive circuit 104 and a data line drive circuit 105 of a liquid crystal display apparatus 101. In this embodiment, scanning line address data (A0–A15) and display data (D0–D1279) must be differentiated. A signal AH/DL is used for the differentiation. The AH/DL signal at a high (Hi) level represents scanning line address data, and the AH/DL signal at a low (Lo) level represents display data.

The scanning line address data is extracted from the image data PD0–PD3 in a drive control circuit 111 in the liquid crystal display apparatus 101 outputted to the scanning line drive circuit 104 in synchronism with the timing of driving a designated scanning line. The scanning line address data is inputted to a decoder 106 within the scanning line drive circuit 104, and a designated scanning electrode within a display panel is driven by a scanning signal generation circuit 107 via the decoder 106. On the other hand, display data is introduced to a shift register 108 within the data line drive circuit 105 and shifted by four pixels as a unit based on a transfer clock pulse. When the shifting for 1280 pixels on a horizontal one scanning line is completed by the shift register 108, display data for the 1280 pixels are transferred to a line memory 109 disposed in parallel, memorized therein for a period of one horizontal scanning period and outputted to the respective data electrodes from a data signal generation circuit 110.

The data signal generation circuit 110 may include, e.g., a circuit for generating a first data signal modulated according to a V-T characteristic based on display data including gradation display data and generating a second display signal of "black" according to another V-T characteristic. An example of the simplest circuit may include a reference voltage generating circuit for generating plural voltage levels as first data signals and a single reference voltage level as a second data signal and transfer switches for transferring these data signals to the pixels. The reference voltage levels may be determined based on V-T characteristics of the used liquid crystal panel measured in advance.

Further, in this embodiment, the drive of the display panel 103 in the liquid crystal display apparatus 101 and the generation of the scanning line address data and display data in the graphic controller 102 are performed in a non-synchronous manner, so that it is necessary to synchronize the graphic controller 102 and the display apparatus 101 at the time of image data transfer. The synchronization is performed by a signal SYNC which is generated for each one horizontal scanning period by the drive control circuit 111 within the liquid crystal display apparatus 101. The graphic controller 102 always monitors the SYNC signal, so that image data is transferred when the SYNC signal is at a low level and image data transfer is not performed after transfer of image data for one scanning line at a high level. More specifically, referring to FIG. 13, when a low level of the SYNC signal is detected by the graphic controller 102, the AH/DL signal is immediately turned to a high level to start the transfer of image data for one horizontal scanning line. Then, the SYNC signal is turned to a high level by the drive control circuit 111 in the liquid crystal display apparatus 101. After completion of writing in the display panel 103 with lapse of one horizontal scanning period, the drive control circuit 111 again returns the SYNC signal to a low level so as to receive image data for a subsequent scanning line.

EXAMPLE 1

Figure 6:
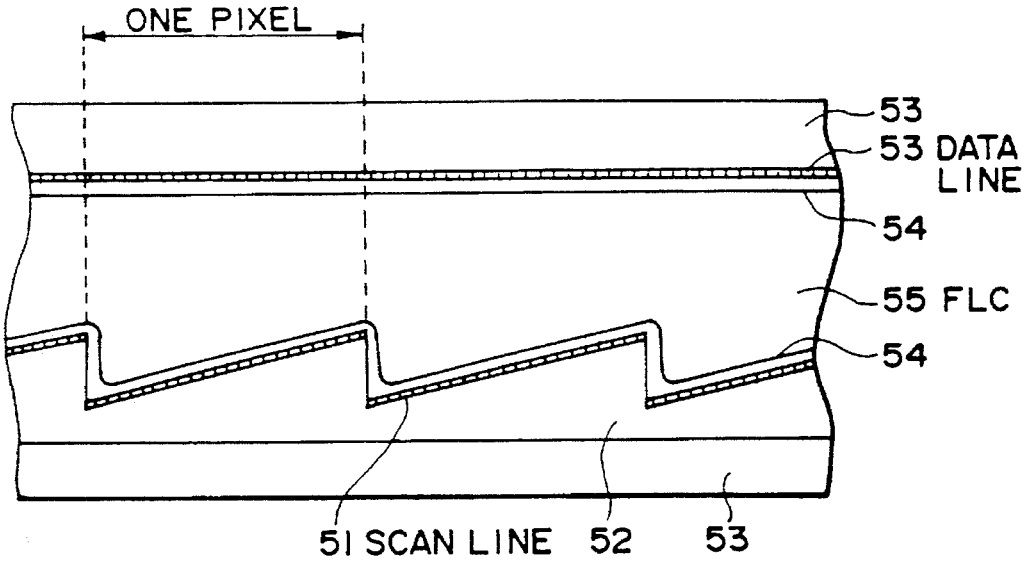
FIG. 6 PRIOR ART
FIG. 6 is a schematic sectional view of a liquid crystal cell applicable to the invention.

As a first embodiment, a liquid crystal cell having a sectional structure as shown in FIG. 6 was prepared. The lower glass substrate 53 was provided with a saw-tooth shape cross section by transferring an original pattern formed on a mold onto a UV-curable resin layer applied thereon to form a cured acrylic resin layer 52.

The thus-formed UV-cured uneven resin layer 2 was then provided with stripe electrodes 51 of ITO film by sputtering and then coated with an about 300 Å-thick alignment film (formed with "LQ-1802", available from Hitachi Kasei K.K.).

The opposite glass substrate 53 was provided with stripe electrodes 51 of ITO film on a flat inner surface and coated with an identical alignment film.

Both substrates (more accurately, the alignment films thereon) were rubbed respectively in one direction and superposed with each other so that their rubbing directions were roughly parallel but the rubbing direction of the lower substrate formed a clockwise angle of about 6 degrees with respect to the rubbing direction of the upper substrate. The cell thickness (spacing) was controlled to be from about 1.0 μm as the smallest thickness to about 1.4 μm as the largest thickness. Further, the lower stripe electrodes 51 were formed along the ridge or ripple (extending in the thickness direction of the drawing) so as to provide one pixel width having one saw tooth span. Thus, rectangular pixels each having a size of 300 μm×200 μm were formed.

Then, the cell was filled with a chiral smectic liquid crystal A showing the following phase transition series and properties.

TABLE 4

(liquid crystal A)

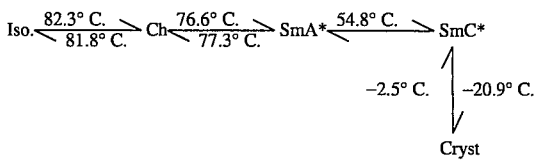

Ps = −5.8 nC/cm$^{2(30° C.)}$
Tilt angle = 14.3 deg.(30° C.)
Δε ≈ −0(30° C.)

Figure 15:
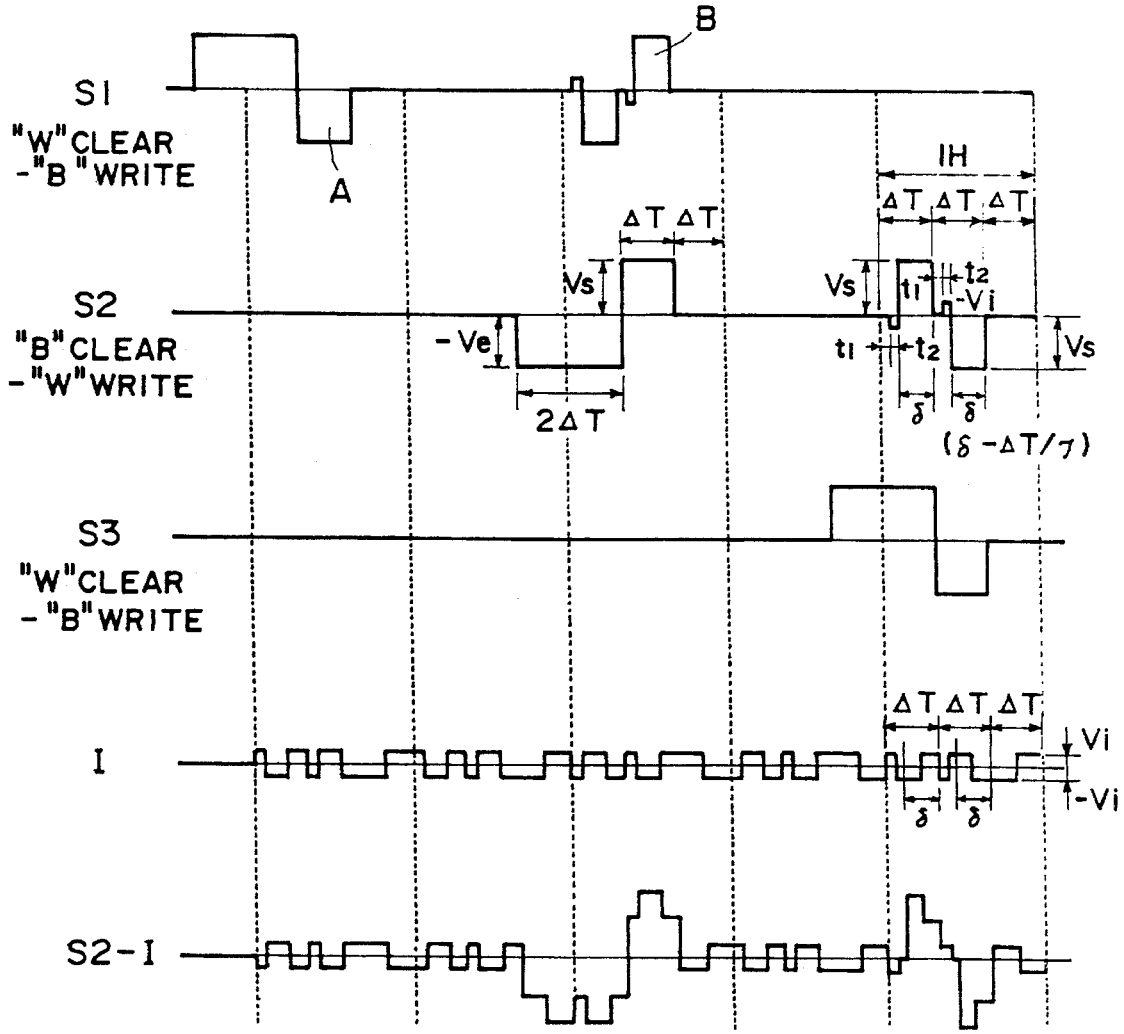
FIG. 15 is a time serial waveform diagram showing drive signals used in Example 1 of the invention.

FIG. 15 is a waveform diagram showing a set of driven signal waveforms used in this embodiment including scanning signals applied to scanning lines $S_1$, $S_2$, $S_3$, . . ., data signals applied to a data line I, and a combined voltage signal applied to a pixel $S_2$—I (i.e., a pixel at the intersection of the scanning line, and the data line I).

In this embodiment, a gradation drive scheme according to the pixel shift method was adopted, so that adjacent two scanning lines were supplied with scanning signals having mutually reverse polarities at corresponding phases.

Referring to FIG. 15, the respective pulses were characterized by parameters of |Ve|=18.0 volts, |Vs|= 17.0 volts, |Vi|=5.0 volts, ΔT= 40 μsec, δ= 26 μsec, $t_1$= 7 μsec and $t_2$=7 μsec.

Figure 16A:
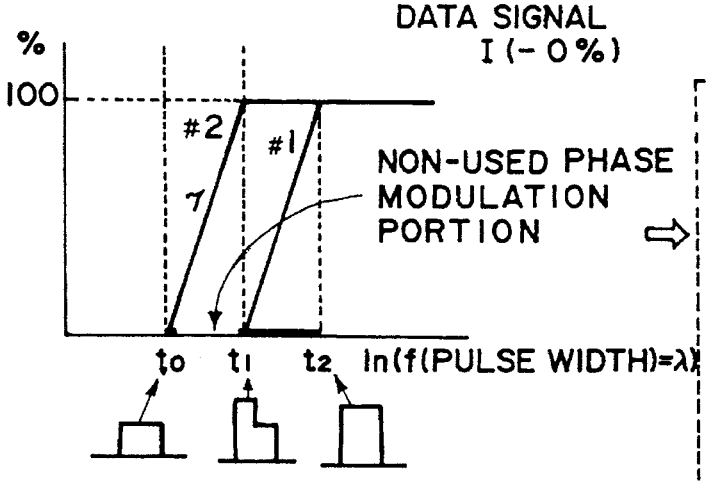
FIG. 16A is a graph showing relationship between transmittance and modulation parameter and FIG. 16B is a waveform diagram showing a set of data signal waveforms used in Example 1.
Figure 16B:
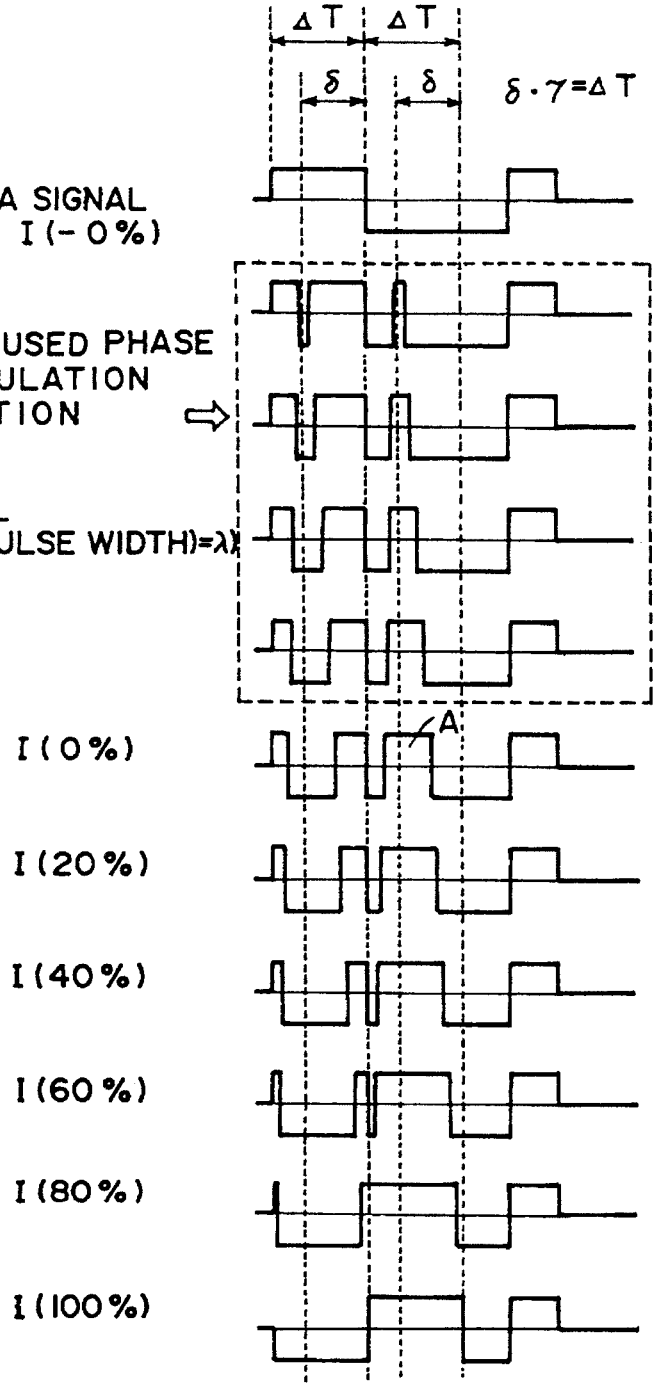

The data signal modulation was effected according to a phase modulation scheme, and an outline of the data signal modulation is illustrated in FIG. 16B. FIG. 16B shows data signal voltage waveforms in the range of I (0%) to I (100%) for displaying the states respectively indicated in the parentheses. In the respective data signals, the width of a pulse portion A is variably modulated so as to provide a voltage signal having a width δ with writing data. The modulation of the portion A is set so that the width δ and the marginal width of the ΔT have a ratio of 1/γ: (1−1/γ).

Such a ratio is set so as to make continuous the thresholds of inversion at a pixel which has been supplied with a scanning signal A in the first writing and a scanning signal B in the second writing in FIG. 15. The width δ is 1/γ of the selection period T of the scanning signal A. This condition is also given in order to make the thresholds continuous. Herein, γ denotes a slope ∂T/∂λ on a curve shown on a coordinate system having an ordinate of transmittance (T) and an abscissa of modulation parameter (λ) as shown in FIG. 16A.

Figure 17A:
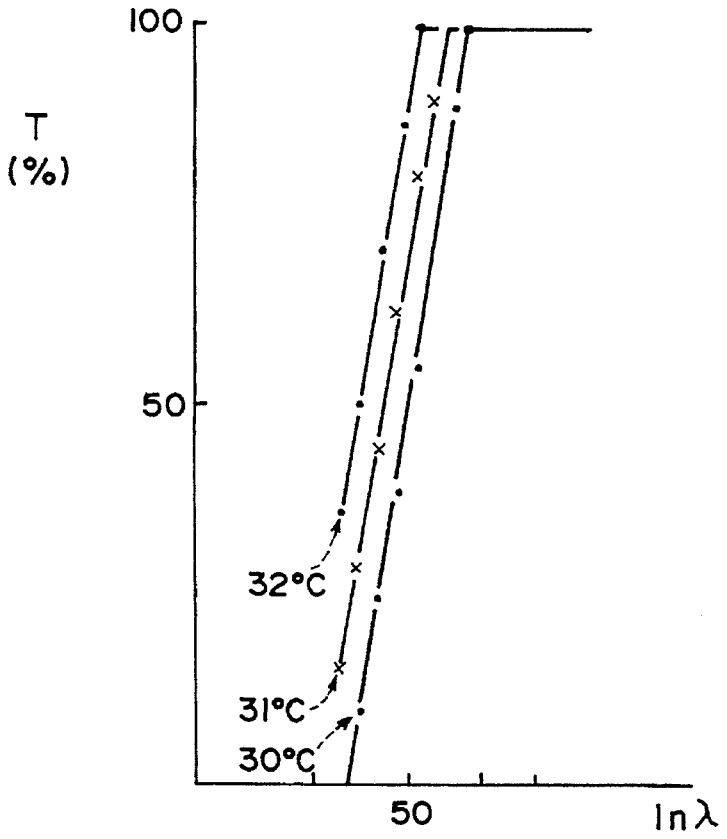
FIG. 17A shows plots of a relationship between transmittance and modulation parameter.
Figure 17B:
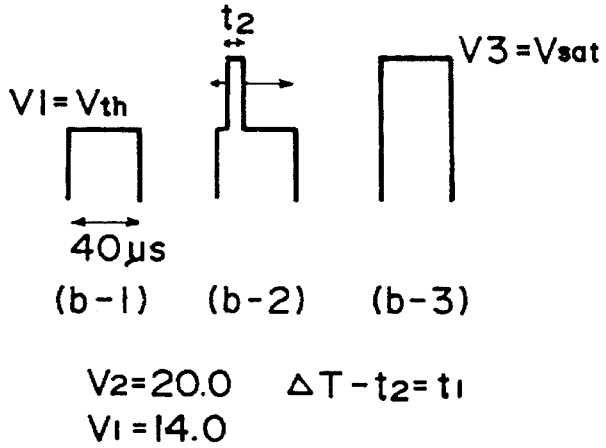
FIG. 17B is an illustration of voltage signals involved in Example 1.

Now, the modulation parameter (λ) will be described. FIG. 17 shows a graph showing a relationship between transmittance (T) and modulation parameter (λ). In the case of using a modulation scheme as shown in FIG. 16B. The abscissa is expressed on a logarithmic scale (ln) so as to represent the change in threshold of a liquid crystal by a parallel shift on the graph. In the drive scheme shown in FIG. 15, the voltage applied to a pixel corresponding to a scanning selection pulse A in a scanning signal varies in a range of from a rectangular voltage of $V_1$= Vth= 14 volts (as shown at (b–1) of FIG. 17B) to a rectangular voltage of $V_3$ = Vsat= 17 volts (at (b–3) of FIG. 17B).

Then, if a modulation parameter (λ) is defined as a period (pulse width) weighed (e.g., multiplied) by a (varying) voltage, it is possible to obtain a relationship between transmittance (T)—lnλ which is linear and may be shifted in parallel in accordance with a temperature change.

The manner of weighing with a voltage (peak value) is explained based on an example. A pulse having a portion showing a peak value $V_1$ in a pulse length of $t_1$ (in total if two portions having $V_1$ are present) and a portion having a peak value $V_2$ in a pulse length $t_2$ may be determined to have a modulation parameter given by:

$$\lambda = (V_2/V_1).t_1+t_2.$$

In case of FIG. 17B, $t_1+t_2$=40 μsec, $V_1$=14 volts and $V_2$—20 volts.

If λ is determined in this way under the conditions of FIGS. 15 and 16, the selection voltage waveform varies in the range of from an L-shaped one having a portion of 10 volts—32 μsec and a portion of 22 volts—8 μsec to a rectangular one having a 100%—portion of 22 volts—40 μsec.

The above range is used for gradational display and a pulse of 10 volts—40 μsec is used for display of 0%. The latter corresponds to a voltage waveform given by a data signal I (–0%) in FIG. 16B.

The most characteristic feature of this embodiment is the use of such a data signal I (–0%) in FIG. 16B.

More specifically, referring to FIG. 16B, the pulse portion A in the data signal increases continuously in the range of from I (0%) to I (100%), but the data signal I (–0%) has a shape discontinuous with the other data signals. The effect thereof is explained with reference to FIG. 16A, wherein a line #1 represents a transmittance (T)— modulation parameter ($\lambda$) characteristic at a low temperature pixel and a line #2 represents a T-$\lambda$ characteristic at a high temperature pixel. When a temperature change occurs, the T-$\lambda$ characteristic line does not change its slope $\gamma$ but moves in parallel on the $\ln\lambda$ axis. In this instance, in the range of $\lambda = t_1$ to $\lambda = t_2$, data signals in the range of $I_1$ (0%) to I (100%) are used to effect a gradational display by compensating for a change due to a temperature change according to the above-described pixel shift method.

However, if a pixel is expected to display "black" (0%), a data signal I (–0%) corresponding to $\lambda = t_0$ is used. As a result, 0% can be displayed regardless of a temperature change. In this instance, the principle of the above-mentioned pixel shift method is not substantially used. Accordingly, I (0%) means not an absolute 0% level but a gradation level shifted from the absolute 0 % level by a minimum gradation step toward the white display side.

The above-description has been made with reference to the case (or line) of "black" clear (reset) followed by "white" write. On the other hand, in the case (or line) of "white" clear (reset) followed by "black" write, a discontinuous display signal is applied for displaying a 100% (maximum) transmittance.

By using a discontinuous or dual-mode data signal modulation scheme, it has become possible to realize a gradational display of a good quality and a high 100%/0 % contrast.

As described above, according to the present invention, it is possible to realize a gradational display of a high contrast ratio and good quality even in case of a temperature change.

What is claimed is:

1. A driving method for a liquid crystal device of the type comprising a pair of oppositely disposed electrode plates having thereon a group of scanning lines and a group of data lines, respectively, and a liquid crystal disposed between the pair of electrode plates so as to form a pixel at each intersection of the Scanning lines and data lines, said driving method comprising:

for displaying a halftone, applying to a data line a halftone signal selected from plural halftone signals determined according to a first relationship between applied voltage and transmittance of a pixel; and for displaying a minimum or a maximum transmittance, applying to a data line an extreme signal determined according to a second relationship between applied voltage and transmittance of a pixel, said second relationship being different from said first relationship, wherein a scanning line is supplied with a reset signal for resetting pixels thereon and then a selection signal for writing, and said halftone signal or extreme signal is selectively applied to a data line for an associated pixel in synchronism with the selection signal.

2. A method according to claim 1, wherein the associated pixel is supplied with a compensation signal after application of the halftone signal or extreme signal to the data line.

3. A method according to claim 1, wherein said first relationship represents a higher threshold characteristic compared with said second relationship.

4. A method according to claim 1, wherein said first relationship represents a relationship for a pixel placed at a certain temperature, and said second relationship represents a relationship for the pixel placed at a temperature which is higher than said certain temperature.

5. A method according to claim 1, wherein said pixel has a threshold distribution such that a portion of the liquid crystal assumes a first orientation state and the remaining portion of the liquid crystal assumes a second orientation state in response to the halftone signal.

6. A method according to claim 1, wherein said reset signal and said selection signal have polarities which alternate for an adjacent scanning line.

7. A method according to claim 1, wherein said liquid crystal is placed in chiral smectic phase.

8. A method according to claim 1, wherein said liquid crystal is a ferroelectric liquid crystal.

9. A method according to claim 7, wherein the chiral smectic liquid crystal in a pixel assumes a state of mixture including a domain of a first orientation state and a domain of a second orientation state in response to a halftone signal applied thereto.

* * * * *

UNITED STATES PATENT AND TRADEMARK OFFICE

CERTIFICATE OF CORRECTION

PATENT NO. : 5,471,229

DATED : November 28, 1995

INVENTOR(S) : SHINJIRO OKADA ET AL.

It is certified that error appears in the above-identified patent and that said Letters Patent is hereby corrected as shown below:

In the drawings:

SHEET 2 OF 12

Figure 1A:
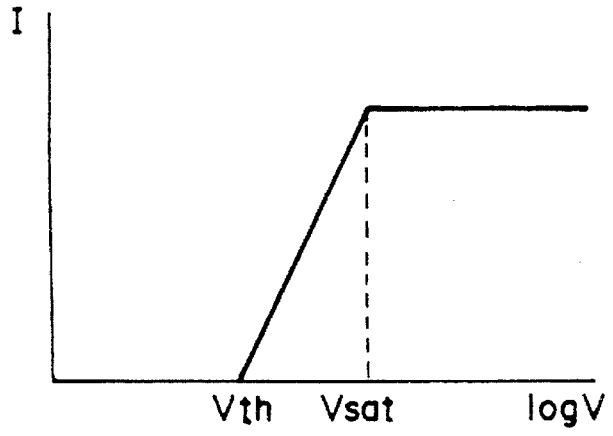
FIG. 1A PRIOR ART
FIGS. 1A and 1B are graphs illustrating a relationship between switching pulse voltage and transmitted light quantity contemplated in a conventional areal modulation method.
Figure 1B:
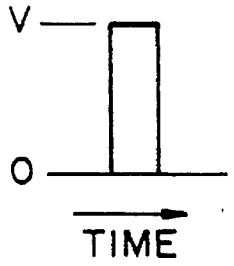
FIG. 1B PRIOR ART
Figure 2A:
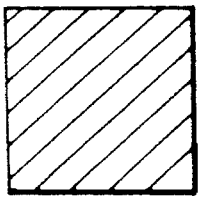
FIG. 2A PRIOR ART
FIGS. 2A–2D illustrate pixels showing various transmittance levels depending on applied pulse voltages.
Figure 2B:
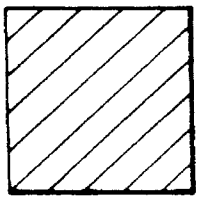
FIG. 2B PRIOR ART
Figure 2C:
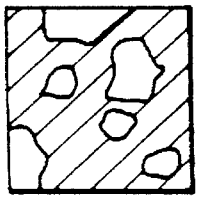
FIG. 2C PRIOR ART
Figure 2D:
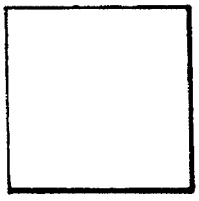
FIG. 2D PRIOR ART
Figure 3:
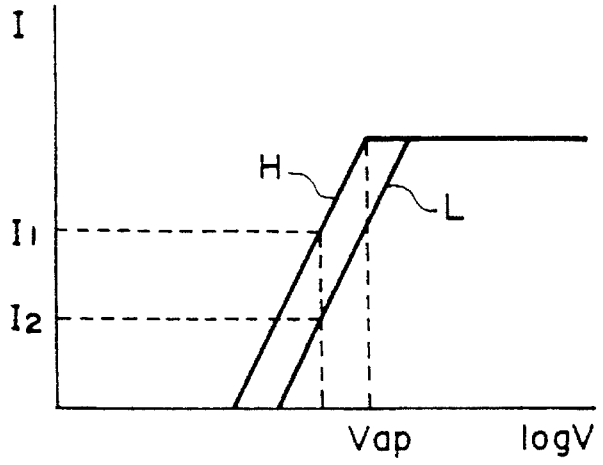
FIG. 3 PRIOR ART
FIG. 3 is a graph for describing a deviation in threshold characteristic due to a temperature distribution.
Figure 4:
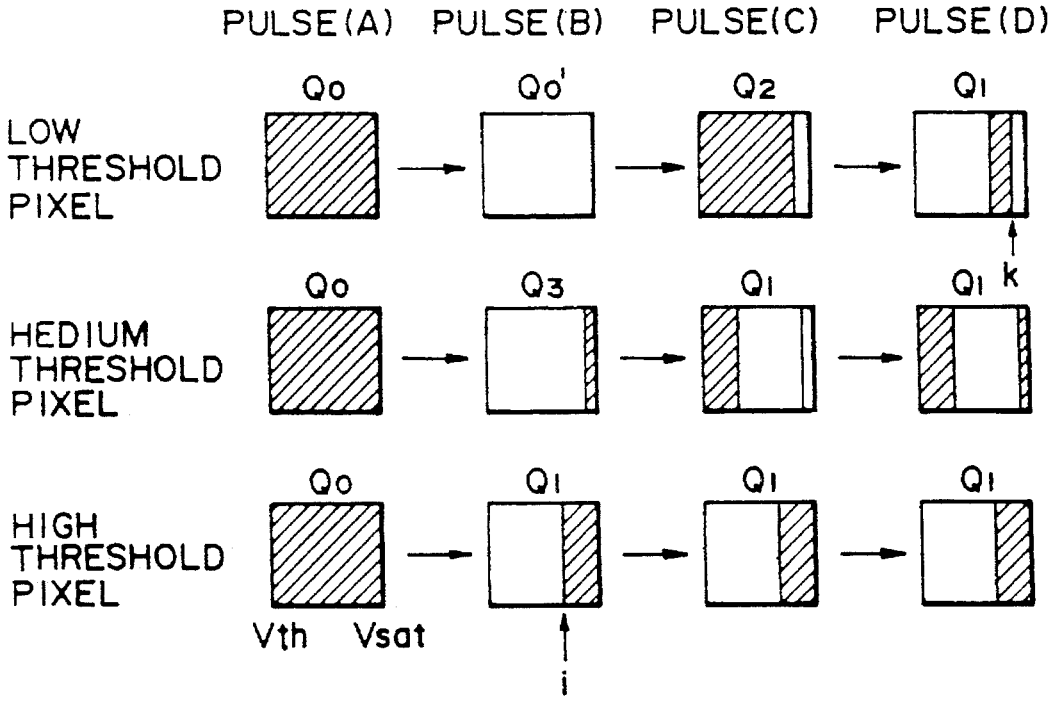
FIG. 4 PRIOR ART
FIG. 4 is an illustration of pixels showing various transmittance levels given in the conventional four-pulse method.
Figure 5:
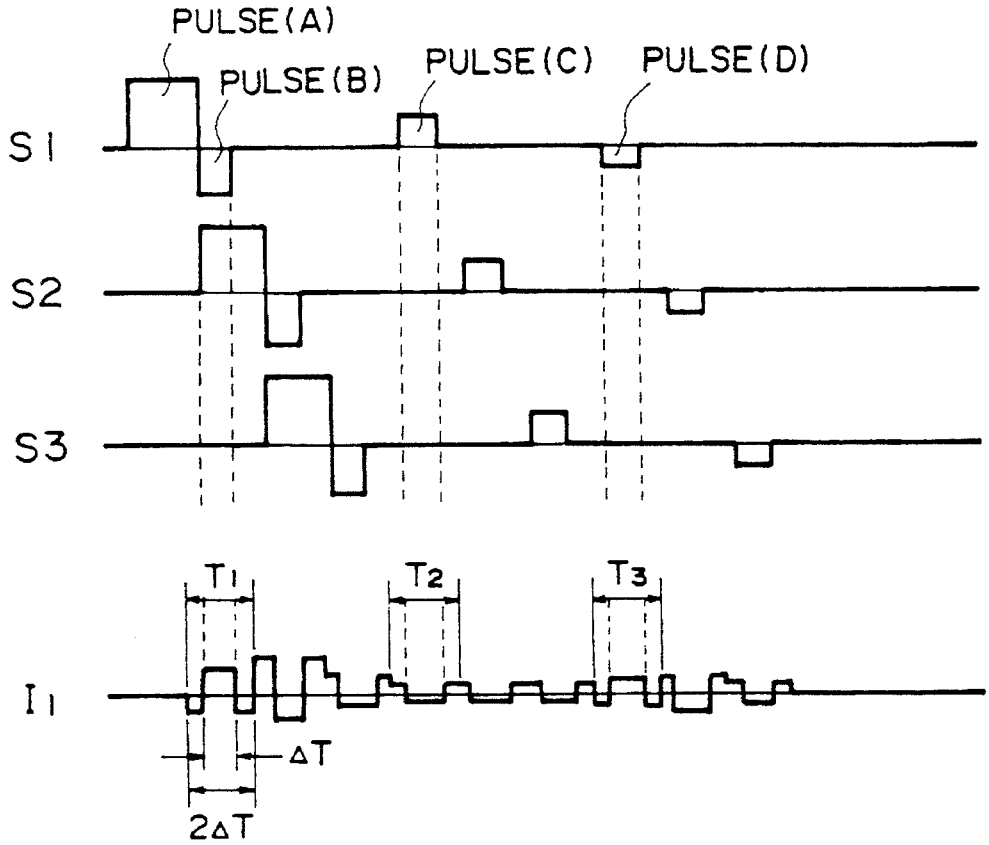
FIG. 5 PRIOR ART
FIG. 5 is a time chart for describing the four-pulse method.

Figure 4, "HEDIUM" should read --MEDIUM--.

COLUMN 2

Line 42, "actuality" should read --in actuality --.

Line 43, "ad" should read --and--.

COLUMN 4

Line 26, "8B" should read --8B. FIG. 8A--.

COLUMN 5

Line 49, "show" should read --shown--.

COLUMN 9

Line 34, "ing" should read --ing to--.

UNITED STATES PATENT AND TRADEMARK OFFICE

CERTIFICATE OF CORRECTION

PATENT NO. : 5,471,229

DATED : November 28, 1995

INVENTOR(S) : SHINJIRO OKADA ET AL.

It is certified that error appears in the above-identified patent and that said Letters Patent is hereby corrected as shown below:

COLUMN 11

Line 30, "layer 2" should read --layer 52--.

COLUMN 13

Line 44, "Scanning" should read --scanning--.

Signed and Sealed this

Fourth Day of June, 1996

*Attest:*

*Attesting Officer*

BRUCE LEHMAN

*Commissioner of Patents and Trademarks*